US007415790B1

(12) United States Patent
Ruhland et al.

(10) Patent No.: US 7,415,790 B1
(45) Date of Patent: Aug. 26, 2008

(54) SLIDABLE SWING ARM MOUNT FOR WEAPON

(75) Inventors: Andrew S. Ruhland, 120 Mockingbird La., Spring Lake, NC (US) 28390; Joseph A. Bruce, Spring Lake, NC (US)

(73) Assignee: Andrew S. Ruhland, Spring Lake, NC (US)

( * ) Notice: Subject to any disclaimer, the term of this patent is extended or adjusted under 35 U.S.C. 154(b) by 288 days.

(21) Appl. No.: 10/928,337

(22) Filed: Aug. 27, 2004

(51) Int. Cl.
*F41A 31/00* (2006.01)

(52) U.S. Cl. ..... 42/94; 89/37.01

(58) Field of Classification Search ..... 42/94; 89/37.01; 248/281.11
See application file for complete search history.

(56) References Cited

U.S. PATENT DOCUMENTS

| | | | | | |
|---|---|---|---|---|---|
| 2,143,900 | A * | 1/1939 | Rarey | 224/553 |
| 2,282,742 | A * | 5/1942 | Poysa | 89/37.03 |
| 3,115,062 | A * | 12/1963 | Tassie et al. | 89/37.01 |
| 4,225,106 | A * | 9/1980 | Eplan | 248/282.1 |
| 4,430,922 | A | 2/1984 | Fog et al. | |
| 4,687,167 | A * | 8/1987 | Skalka et al. | 248/126 |
| 4,783,036 | A * | 11/1988 | Vossoughi | 248/281.11 |
| 5,379,205 | A | 1/1995 | Peng | |
| 5,518,083 | A * | 5/1996 | Blennert | 182/188 |
| 5,697,180 | A * | 12/1997 | Morizio | 42/94 |
| 5,772,174 | A * | 6/1998 | Hirsch et al. | 248/447.1 |
| 5,778,589 | A | 7/1998 | Teague | |
| 5,913,668 | A * | 6/1999 | Messer | 42/94 |
| 5,933,999 | A * | 8/1999 | McClure et al. | 42/94 |
| 5,937,561 | A | 8/1999 | Abernethy | |
| 6,269,578 | B1 * | 8/2001 | Callegari | 42/94 |
| 6,283,428 | B1 | 9/2001 | Maples et al. | |
| D471,248 | S | 3/2003 | Jacobs | |
| 6,574,899 | B1 | 6/2003 | Mostello | |
| 6,578,309 | B1 | 6/2003 | Frisce | |
| 6,877,266 | B1 | 4/2005 | Brownlee | |
| 6,935,064 | B1 * | 8/2005 | Thompson | 42/94 |
| 7,028,961 | B1 * | 4/2006 | Dittmer et al. | 248/278.1 |
| 7,040,591 | B1 * | 5/2006 | Simon | 248/458 |
| 7,066,435 | B2 * | 6/2006 | Oddsen et al. | 248/220.43 |
| 2004/0134113 | A1 * | 7/2004 | Deros et al. | 42/94 |
| 2004/0237372 | A1 * | 12/2004 | Frye | 42/94 |
| 2005/0183320 | A1 * | 8/2005 | Krien et al. | 42/94 |

* cited by examiner

*Primary Examiner*—Troy Chambers
(74) *Attorney, Agent, or Firm*—Coats & Bennett, P.L.L.C.

(57) ABSTRACT

A device for moveably securing a weapon to a vehicle comprises a mounting platform having a frame, a rail, and a carriage selectively slidable, and optionally selectively lockable, along the rail; a swing arm assembly supported by the carriage, the swing arm having first and second elongate arms connected via a pivot joint, the second arm connected to, and supported by, the carriage via the first elongate arm; the second arm forming a first portion of a pintle connection that rotatably supports the weapon; the pivot joint including a locking mechanism operative to selectively lock the second arm relative to the first arm. The pintle connections of the device may use non-tapering pintles. The device may further comprise a yoke rotatably coupled to the second arm via the first portion of the pintle connection, the yoke adapted to rotatably support the weapon. Methods are also described.

14 Claims, 6 Drawing Sheets

SLIDABLE SWING ARM MOUNT FOR WEAPON

BACKGROUND OF THE INVENTION

The present invention relates to mounting a weapon to a vehicle via a slidable swing arm assembly.

It is often desirable to mount a weapon, such as a machine gun, to a vehicle in such a fashion as to allow the weapon to be aimed and/or fired in many directions. For example, when a machine gun is mounted to a humvee, it is advantageous if the machine gun can be readily repositioned to fire in forward, sideways, and rearward directions, while maintaining control over the machine gun and without remounting the machine gun. In the prior art, it is common for the machine gun to be mounted using a single fixed point gun mount that allows for the machine gun to be rotated about a single axis. However, moving the machine gun to point in the various desired directions frequently requires that the machine gun be swung past an obstruction, such as a windshield corner post or the like. In addition, it is frequently advantageous to allow the gun mounting to be adjustable so as to accommodate different size individuals and/or personal preferences. Thus, providing a fixed, single position gun mount is less than ideal. Accordingly, there remains a need for additional approaches to mounting a weapon on a vehicle in a moveable fashion.

SUMMARY OF THE INVENTION

The present invention, in some embodiments, may provide a device for moveably securing a weapon to a vehicle comprising a mounting platform having a frame, a rail, and a carriage selectively slidable along the rail; a swing arm assembly supported by the carriage, the swing arm having first and second elongate arms connected via a pivot joint, the second arm connected to, and supported by, the carriage via the first elongate arm; the second arm forming a first portion of a pintle connection that rotatably supports the weapon; the pivot joint including a locking mechanism operative to selectively lock the second arm relative to the first arm. The carriage may be slidable generally vertically along the rail and/or slidable generally horizontally along the rail. The carriage may advantageously be selectively lockable along the rail. The first portion of the pintle connection may comprise a collar having a first bore, the first bore having non-tapering sidewalls. The device may further comprise a yoke rotatably coupled to the second arm via the first portion of the pintle connection, the yoke adapted to rotatably support the weapon. The swing arm may advantageously include a second portion of a second pintle connection for mating to the carriage, the second portion of the second pintle connection comprising a generally cylindrical post. The carriage may comprise a collar having a bore, the bore having non-tapering sidewalls and sized to accept the post. The first portion of the pintle connection may further comprise a passage disposed generally transverse to the first bore for accepting a locking pin for securing the pintle connection. One or more of the various optional aspects may be combined in various ways in various embodiments of the invention.

In other embodiments, the present invention may provide a method of moveably securing a weapon to a vehicle comprising: providing a mounting platform having a frame, a rail, and a carriage slidable along the rail; mounting the mounting platform to the vehicle; supporting a swing arm assembly by the carriage, the swing arm having first and second elongate arms connected via a pivot joint, the second arm connected to, and supported by, the carriage via the first arm; mating the weapon to the swing arm via a pintle connection that rotatably supports the weapon; and adjusting the position of the carriage relative to the rail and thereafter releasably locking the carriage to the rail. The method may further advantageously comprise selectively locking the second arm relative to the first arm. The adjusting of the method may advantageously comprise sliding the carriage generally vertically along the rail. The mounting of the method may advantageously comprise releasably securing the mounting platform to the vehicle. The mating of the method may advantageously comprise mating a yoke to the swing arm assembly. The mating the weapon to the swing arm may advantageously comprise mating the weapon to the swing arm via a pintle connection having a non-tapering pintle shaft. The method may advantageously further comprise selectively locking the swing arm assembly rotationally relative to the carriage. One or more of the various optional aspects may be combined in various ways in various embodiments of the invention.

In another still other embodiments, the present invention may provide an assembly for moveably securing a weapon to a vehicle comprising: a mounting platform affixed to the vehicle, the mounting platform having a rail and a carriage slidably supported by the rail; a swing arm supported by the mounting platform via the carriage, the swing arm having at least a first elongate member extending from proximate the carriage to a pivot joint and a second elongate member extending distally from the pivot joint to a pintle receiver, the first and second members pivotally connected via the pivot joint; a yoke coupled to the swing arm via the pintle receiver and adapted to mate with the weapon. The carriage may advantageously be selectively lockable along the rail. The pintle receiver may comprise a collar having a bore, the bore having non-tapering sidewalls. The mounting frame may advantageously further comprise a mounting frame supporting the rail, wherein the mounting frame detachably mounts to the vehicle. The carriage of the mounting frame may comprise a mounting member having a bore, the bore having non-tapering sidewalls. The swing arm may further comprise a locking mechanism, the first and second elongate members of the swing arm selectively lockable rotationally relative to each other via the locking mechanism. The locking mechanism may advantageously comprises a crank. The carriage may be slidable generally vertically along the rail. The assembly may further comprise a lock mechanism operative to lock the swing arm rotationally relative to the carriage. One or more of the various optional aspects may be combined in various ways in various embodiments of the invention.

DESCRIPTION OF AT LEAST ONE EMBODIMENT OF THE INVENTION

The present invention provides a means to mount a weapon to a vehicle in a moveable fashion. For the present discussion, a machine gun 10 will be used as an illustrative example of a weapon, but it should be understood that the term "weapon" as used herein means any weapon designed to be manually directed and fired by a single individual, such as a machine gun 10, grenade launcher, and the like. Also, a motor vehicle commonly referred to as a humvee, generally indicated at 5, will be used as an illustrative example of a vehicle, but it should be understood that the invention is not so limited.

Figure 1:
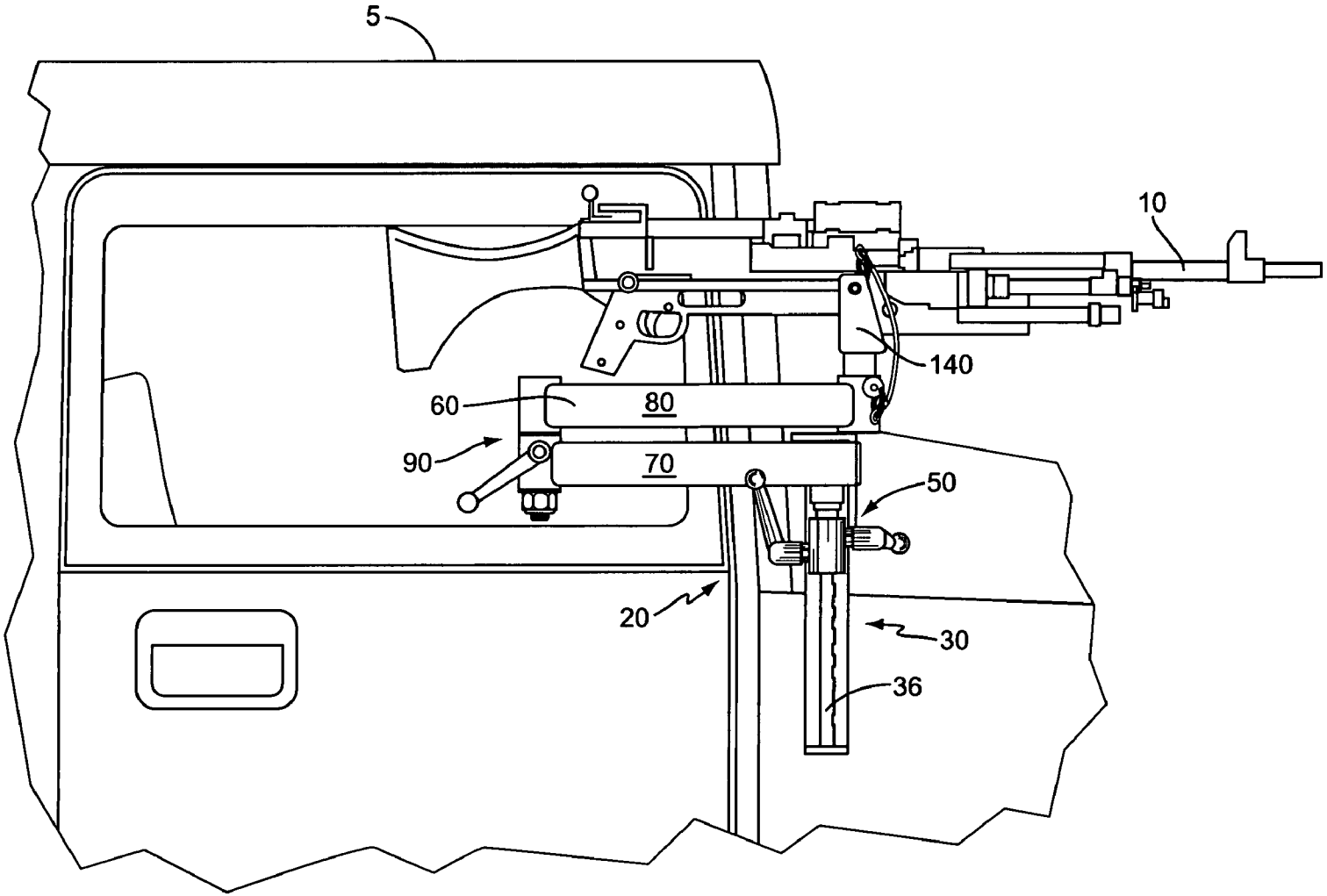
FIG. 1 shows a perspective view of the device according to one embodiment of the invention attached to a vehicle.
Figure 2:
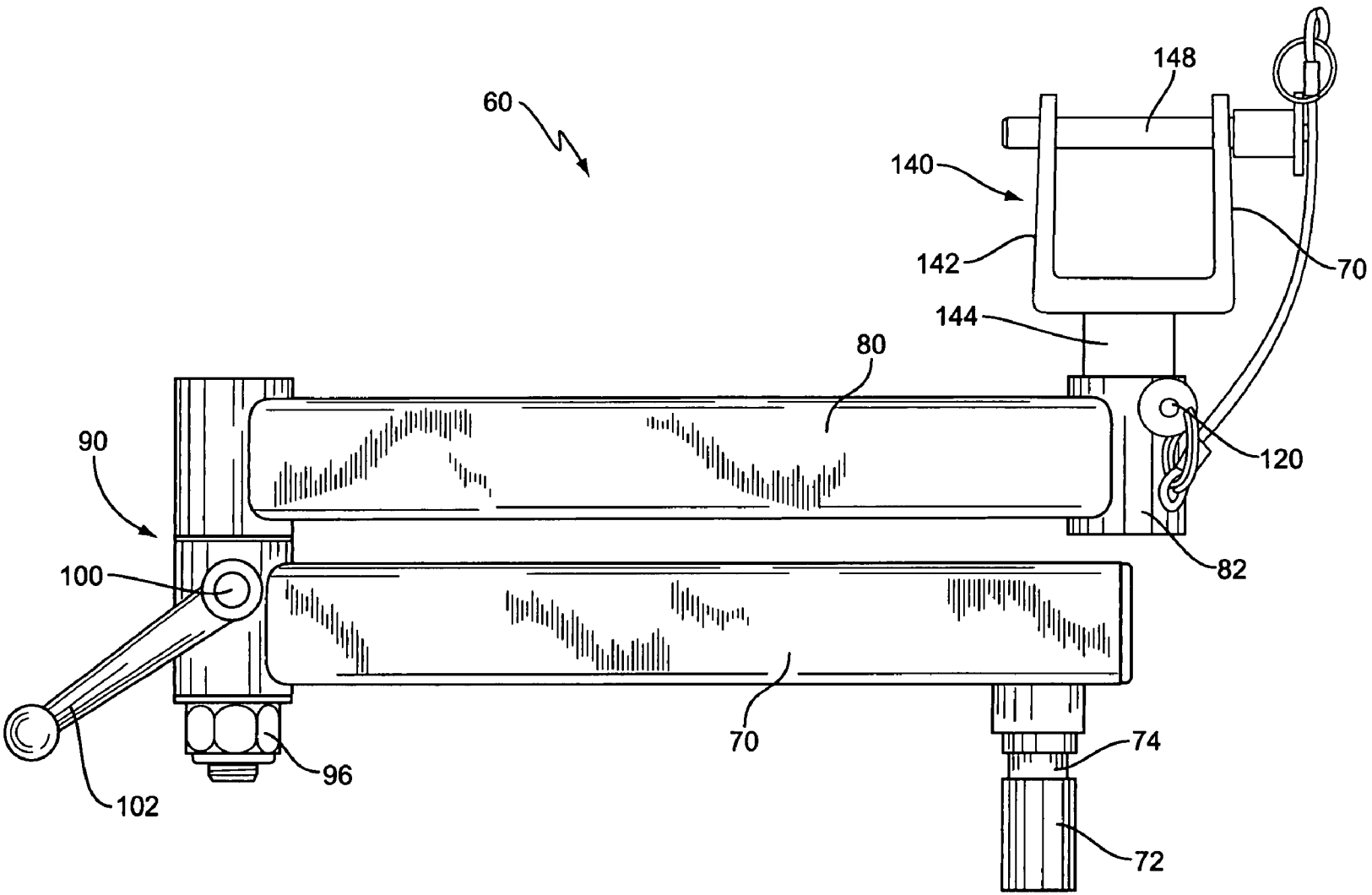
FIG. 2 shows the mounting assembly of FIG. 1 with a yoke attached.
Figure 3:
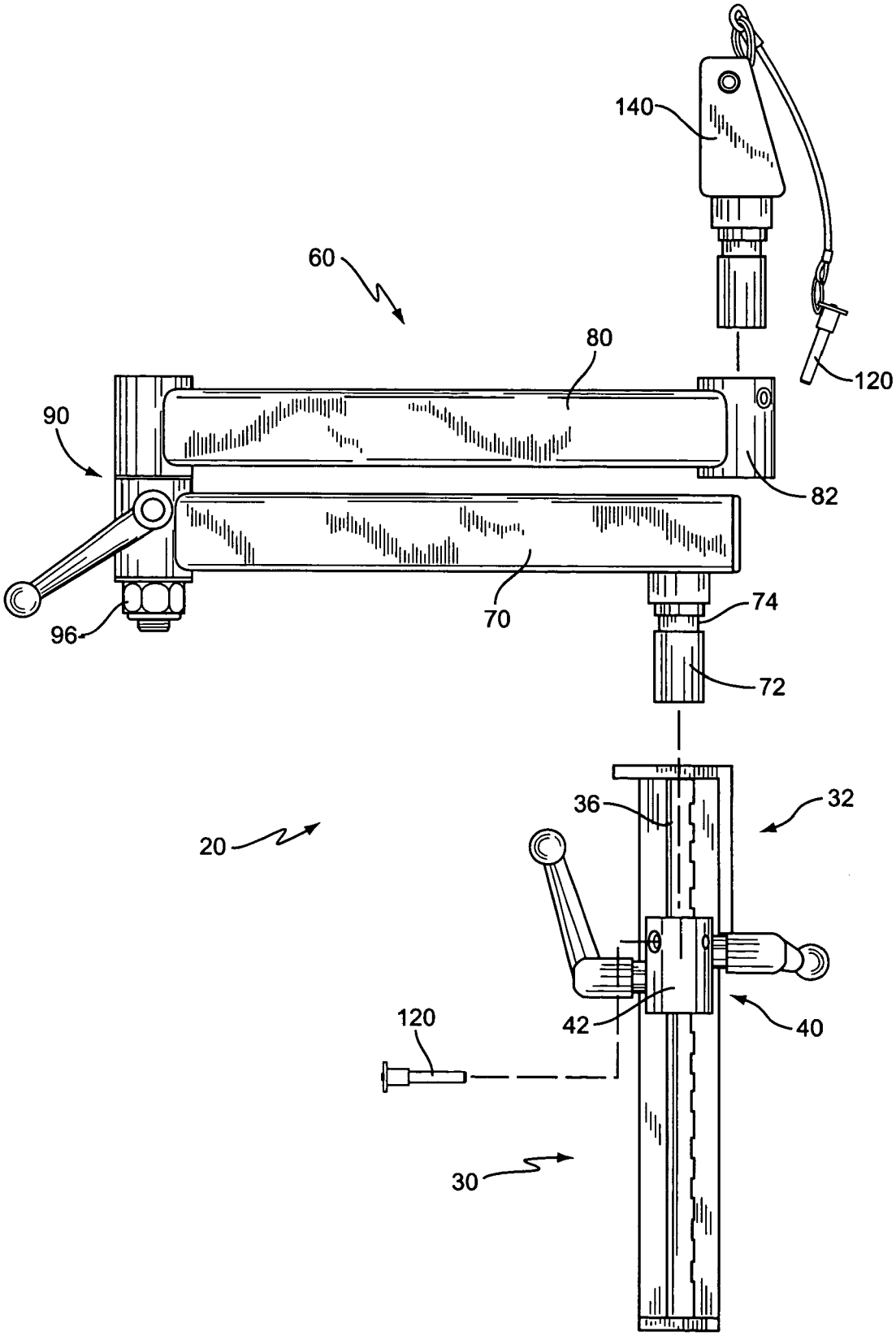
FIG. 3 shows a partially exploded view of the mounting assembly of FIG. 2.
Figure 4B:
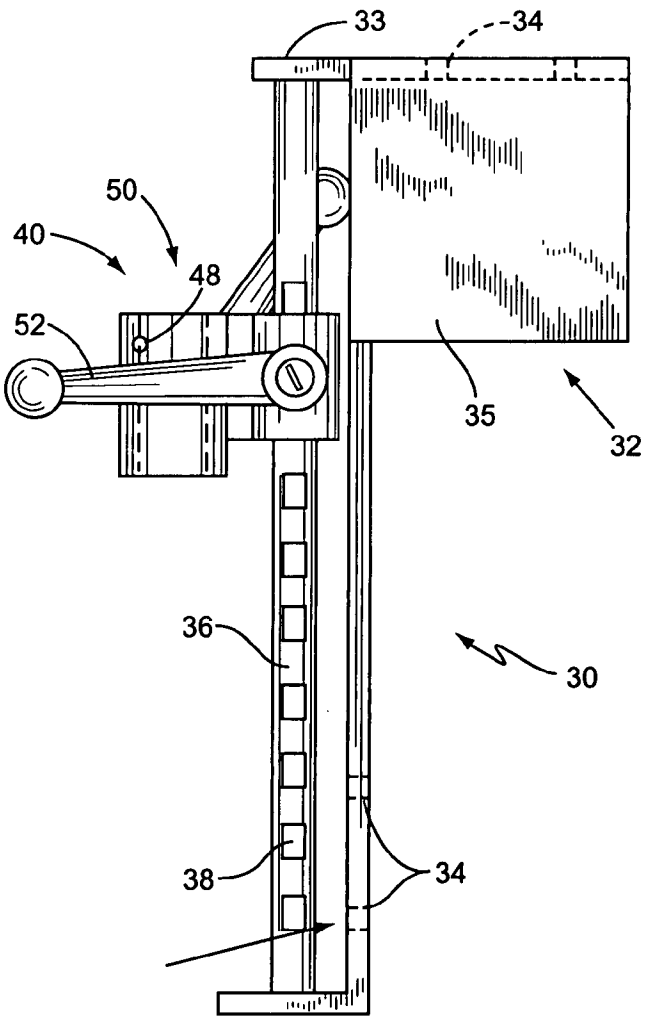
FIGS. 4A and 4B show one embodiment of a mounting platform.
Figure 4A:
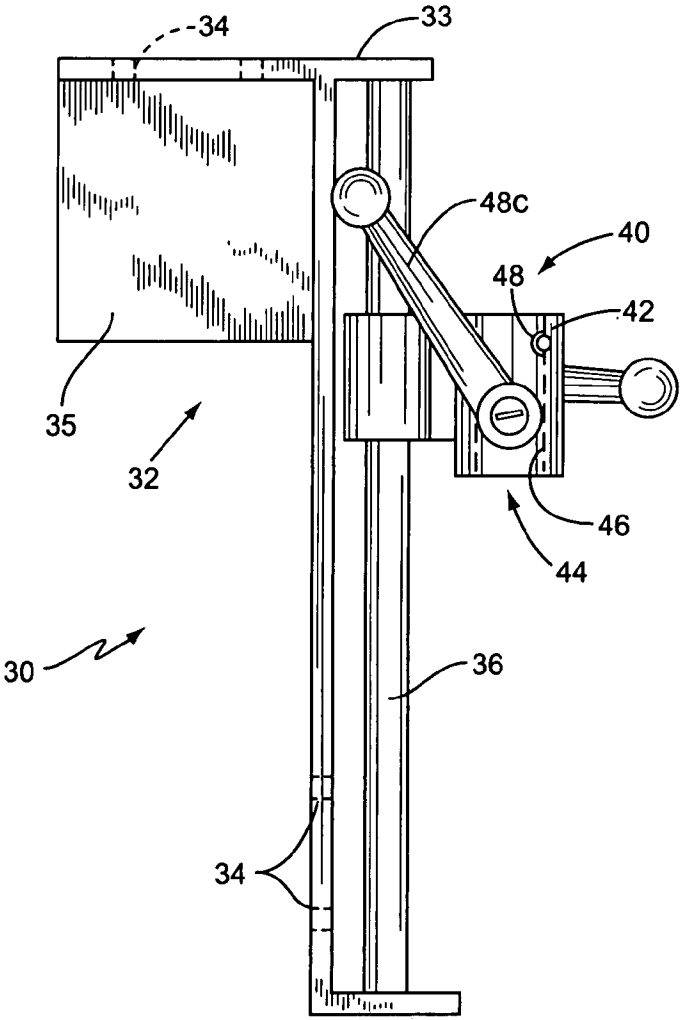
Figure 5:
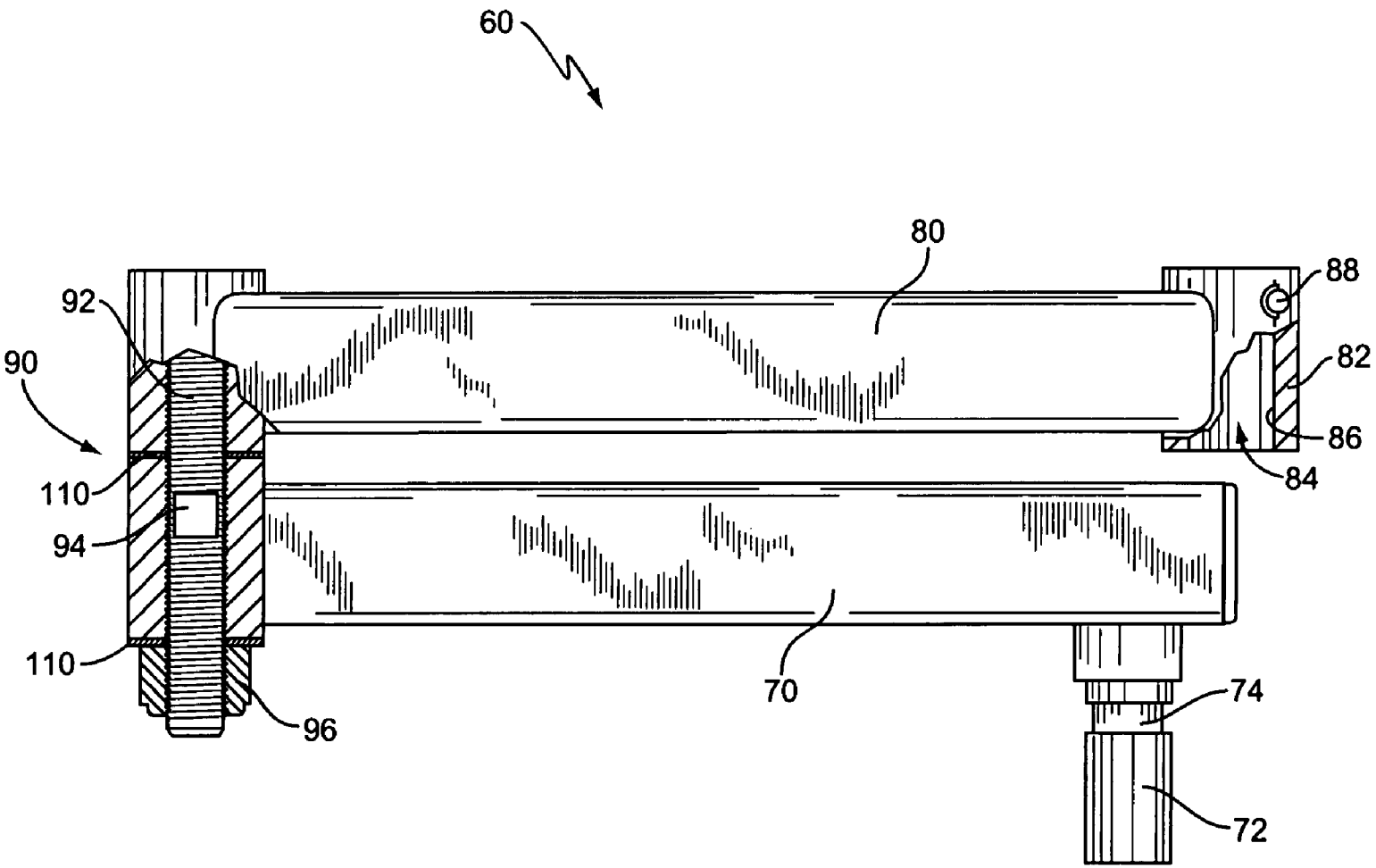
FIG. 5 shows a partial cutaway of at least a portion of the swing arm assembly of FIG. 2.

FIG. 1 shows one embodiment of the mounting assembly of the present invention, indicated generally at 20, being used to mount a machine gun 10 to a humvee 5. Typically, the mounting assembly 20 is mounted on the passenger side of the vehicle 5, towards the front of the vehicle 5, so that the machine gun 10 can be aimed and fired by the non-driving occupant of the vehicle's front seat. The mounting assembly 20 of FIG. 1 includes a mounting platform 30, a swing arm assembly 60, a yoke 140, and locking pins 120.

The mounting platform 30 includes a mounting frame 32, a rail 36, and a carriage 40. The mounting frame 32 advantageously includes a top flange 33 and one or more side flanges 35 welded or otherwise affixed together. The top flange 33 is configured to fit over a suitable generally horizontal upper surface of the vehicle 5, such as the top of the firewall. The side flange(s) 35 are configured to abut suitable generally vertical surfaces of the vehicle 5. The mounting frame 32 is secured to the vehicle 5, preferably in a removable fashion. As such, the top flange 33 advantageously includes a plurality of mounting holes 34 spaced to align with corresponding threaded holes in the vehicle 5. Likewise, the side flange(s) 35 may advantageously include one or more mounting holes 34 spaced to align with corresponding threaded holes in the vehicle 5. The mounting frame 32 may be fixedly secured against the vehicle 5 by passing suitable bolts through the mounting holes 34 and tightening the same.

The rail 36 is affixed to the mounting frame 32, advantageously at its ends so that the middle of the rail 36 is spaced from the mounting frame 32. In the illustrated example, the rail 36 is straight and disposed vertically. The rail 36 may have a smooth outer profile, but advantageously includes a plurality of spaced recesses 38, sometimes referred to herein as notches. In addition, while the rail 36 may have a circular cross section, the rail 36 advantageously includes at least one longitudinally flat area, advantageously at the notches 38.

The carriage 40 is supported by the rail 36 for sliding movement along the rail 36. The carriage 40 advantageously includes a collar 42 and a lock mechanism 50. The collar 42 includes a bore 44 with non-tapering sidewalls 46 and advantageously a locking pin passage 48 disposed transverse to the axis of the bore 44. The bore 44 acts as a female portion of a pintle connection, as discussed further below. The lock mechanism 50 may take any suitable form, but advantageously takes the form a simple crank handle 52 with a threaded shaft on the distal end. The crank 52 is threaded into a corresponding hole in the carriage 40 so as to engage the rail 36, and press there against when the crank 52 is tightened. Thus, the lock mechanism 50 acts against the rail 36 to secure the carriage 40 relative to the rail 36 at a point selected by the user. Advantageously, the tip of the crank 52 engages a notch 38 so as to positively interlock with the rail 36 when tightened.

The swing arm assembly 60 includes an inboard arm 70 and an outboard arm 80 interconnected by a pivot joint 90. As shown in the figures, the inboard arm 70 is generally elongate, and may have a rectangular, circular, or any other desired cross-section. The proximal end of the inboard arm 70 includes suitable means to mate with the carriage 40 of the mounting platform 30. In the illustrated example, the inboard arm 70 includes a pintle shaft 72 extending perpendicularly to its longitudinal direction. This pintle shaft 72 advantageously includes an annular groove 74 and has a shape generally complementary to the bore 44 of the carriage 40. The pintle shaft 72 is inserted into the bore 44 of the carriage 40, and a suitable locking pin 120 is inserted through the carriage 40 and the annular groove 74 to rotatably secure the swing arm assembly 60 to the mounting platform 30. The distal end of the inboard arm 70 advantageously forms a portion of the pivot joint 90 as discussed further below.

The outboard arm 80 is likewise generally elongate, and may have a rectangular, circular, or any other desired cross-section. The distal end of the outboard arm 80 includes suitable means to mate with the machine gun 10 and/or an intervening yoke assembly 140. In the illustrated example, the outboard arm 80 includes a collar 82 having a bore 84 with non-tapering sidewalls 86 and a locking pin passage 88 disposed transverse to the axis of the bore 84. This collar 82 is configured to mate with a pintle shaft from the machine gun 10 (or yoke) and to be rotatably secured thereto via suitable locking pins 120. Thus, the collar 82 forms a portion of a pintle connection that rotatably supports the machine gun 10 at the distal end of the outboard arm 80.

As pointed out above, the proximal and outboard arms 70,80 are connected via a pivot joint 90. The pivot joint 90 may take any suitable form that allows relative rotation of the proximal and outboard arms 70,80 about a common axis. For example, the pivot joint 90 may include a shaft 92 secured to (or integrally formed with) the outboard arm 80, with the shaft 92 passing through the distal portion of the inboard arm 70 and secured by a suitable nut 96. It may be advantageous to dispose one or more washer type bushings 110 between the arms 70,80, and between the nut 96 and the inboard arm 70, in order to prevent binding. The pivot joint 90 advantageously includes a lock mechanism 100 that allows the relative positions of the arms 70,80 to be fixed. In one embodiment, the lock mechanism 100 takes the form of a simple crank handle 102 with a threaded portion 104 on the end. The threaded portion 104 extends through a threaded hole (not shown) in the distal end of the inboard arm 70 to engage the shaft 92 when the crank 102 is tightened. Advantageously, the shaft 92 includes a suitable flat area 94 that aligns with the tip of the threaded portion 104 of the crank 102 when the two arms 70,80 are aligned, so that the arms 70,80 may be locked down in an aligned storage or "travel" position when not in active use. Further, if desired, the pivot joint 90 may be suitably sealed or otherwise configured to allow for lubrication of the pivot joint 90, such as by providing a suitable grease fitting (not shown) on the distal end of the inboard arm 70. Of course, it should be understood that the male/female pivot mechanism on the proximal and outboard arms 70,80 may be reversed if desired.

The yoke 140 may advantageously take the form of a simple Y-shaped frame 142 that joins to the distal end of the outboard arm 80 of the swing arm assembly 60 via a pintle connection. The Y-shaped frame may include a downwardly extending pintle shaft 144 having an annular groove 146. In order to rotatably mate the yoke 140 to the swing arm assembly 60, the pintle shaft 144 is inserted into the bore 84 and a suitable locking pin 120 is positioned to extend through the annular groove 146. The machine gun 10 is rotationally mounted between the upturned arms of the Y-shaped frame 142 using a gun mounting pin 148 in a conventional fashion.

To use the mounting assembly 20, the mounting platform 30 is securely mounted to the vehicle 5. The swing arm assembly 60 is rotatably mated to the mounting platform 30 by fitting pintle 72 into bore 44 and securing with locking pin 120 through hole 48. Before or after mounting the swing arm assembly, the yoke 140 is rotatably mated to the distal end of the swing arm assembly 60 by fitting pintle 144 into bore 84 and securing with locking pin 120 through hole 88. The machine gun 10 is mated to the yoke 140 via gun locking pin 148.

When in active use, the pivoting action of the swing arm assembly 60 allows the machine gun 10 to be readily moved about so as to be aimed in the desired direction. Further, the multiple articulations of the swing arm assembly 60 advantageously allow the machine gun 10 to be so moved without hitting any intervening obstacles. For the embodiment shown in FIG. 1, the machine gun 10 may be pointed forward, sideways, or rearward. Indeed, pointing the machine gun 10 in the forward direction may be through the space normally occupied by the windshield, or may be laterally displaced therefrom.

In addition, the mounting assembly 20 of the illustrative embodiment allows the height of the swing arm assembly 60, and therefore the machine gun 10, to be adjusted vertically as desired. Thus, a short user may lower the machine gun 10 to a comfortable position, while another taller user may quickly and easily raise the machine gun 10 to his/her desired height, by simply releasing and tightening the lock mechanism 50.

When not in active use, such as when the vehicle 5 is merely traveling from one point to another (rather then patrolling), the locking mechanism 100 of the pivot joint 90 allows the arms 70,80 of the swing arm assembly 60 to be relatively secured. This locking mechanism 100 may advantageously be quickly and easily released by simply giving the crank handle 102 a quick downward hit, thereby disengaging the crank 102 from the shaft 92. Of course, other approaches to quick-release locking may alternatively be used.

Similarly, some embodiments of the present invention allow the relative angular position of the inboard arm 70 to the mounting platform 30 to be fixed, when not in active use, by tightening crank 48*c* associated with the joint between the pintle 72 and bore 44 against a flat spot (not shown) on the pintle 72.

It should be noted that many embodiments of the present invention utilize pintle connections with non-tapering pintle shafts. While tapering shafts have an advantage of being self-centering, the present inventors have discovered that suitable tapered pintle shafts are very difficult to manufacture and the corresponding pintle connections are prone to being fouled by debris. In response to this, the inventors hereof developed the pintle connections using non-tapering shafts, which are easier to manufacture and are believed to be better at self-cleaning during assembly.

Figure 6:
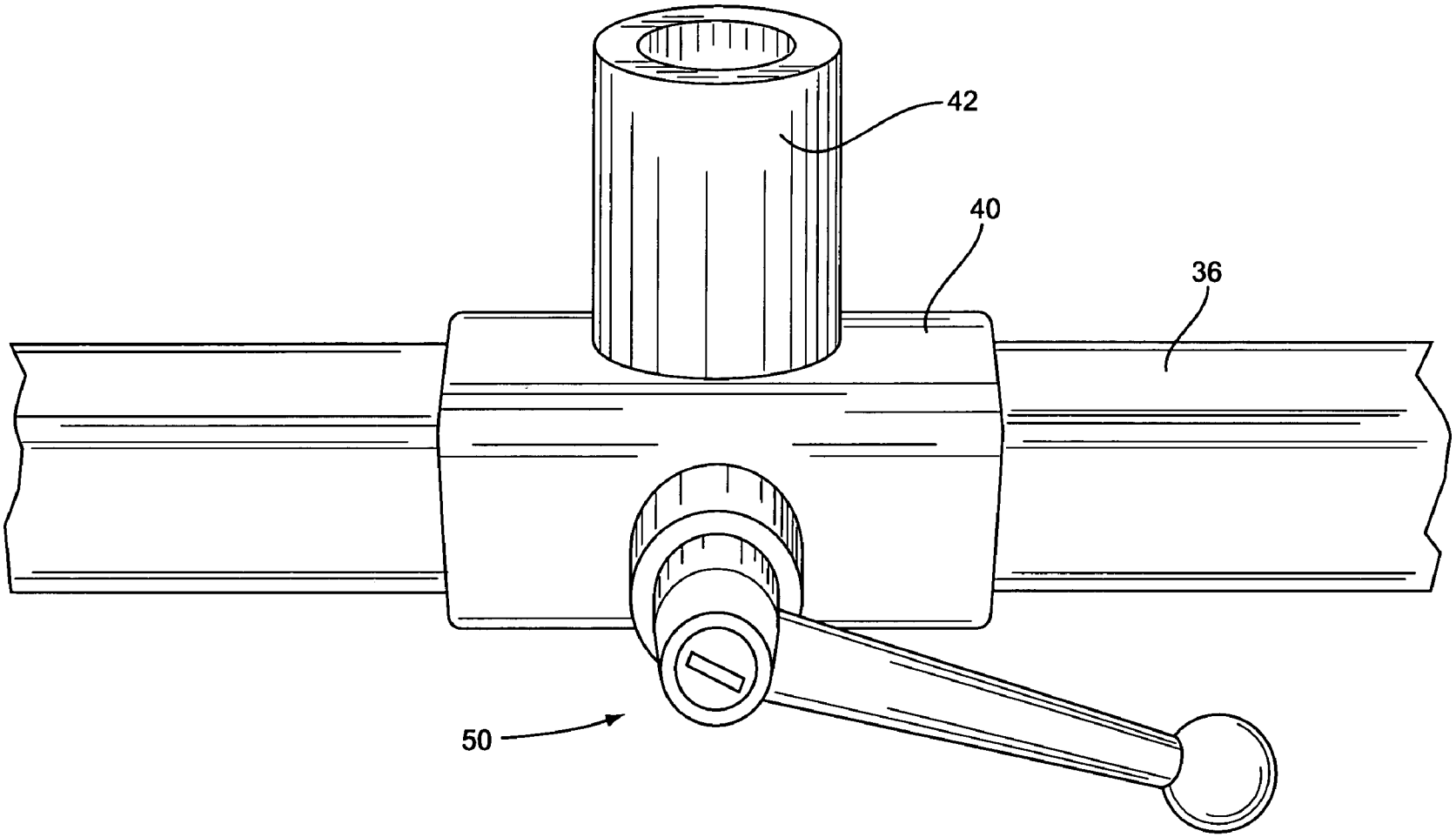
FIG. 6 shows a mounting platform slidably mounted along a horizontal rail.

The discussion above has been in terms of a mounting assembly 20 having a vertical rail 36; however this feature is not required in all embodiments. Indeed, the mounting platform 30 may be attached to the rear portion of the vehicle 5, and the rail 36 thereof may be horizontally disposed. See FIG. 6. Note that through proper design, the rail 36 need not be linear, but may instead be curved if desired.

The present invention may be carried out in other specific ways than those herein set forth without departing from the scope of the present invention as set forth in the claims, and equivalents thereto. The present embodiments are, therefore, to be considered in all respects as illustrative and not restrictive, and all changes coming within the meaning and equivalency range of the appended claims are intended to be embraced therein.

What is claimed is:

1. An assembly for moveably securing a weapon to a vehicle, comprising:

a mounting platform affixed to the vehicle, said mounting platform having a rail extending along a longitudinal axis thereof and a carriage slidably supported by said rail via a first bore in said carriage, said carriage being slidable along said rail longitudinal axis to a plurality of operative positions along said rail;

a swing arm supported by said mounting platform via said carriage, said swing arm having at least a first elongate member extending from proximate said carriage to a pivot joint and a second elongate member extending distally from said pivot joint to a pintle receiver, said first and second members pivotally connected via said pivot joint;

a yoke coupled to said swing arm via said pintle receiver and adapted to mate with the weapon.

2. The assembly of claim 1 wherein said carriage is selectively axially lockable into one of said plurality of operative positions along said rail longitudinal axis.

3. The assembly of claim 1 wherein said pintle receiver comprises a collar having a bore, said bore having non-tapering sidewalls.

4. The assembly of claim 1 wherein said mounting platform further comprises a mounting frame supporting said rail, wherein said mounting frame detachably mounts to the vehicle.

5. The assembly of claim 1 wherein said carriage of said mounting platform comprises a mounting member having a bore, said bore having non-tapering sidewalls.

6. The assembly of claim 1 wherein said swing arm further comprises a locking mechanism, said first and second elongate members of said swing arm selectively lockable rotationally relative to each other via said locking mechanism.

7. The assembly of claim 6 wherein said locking mechanism comprises a crank.

8. The assembly of claim 1 wherein said carriage is slidable generally vertically along said rail.

9. The assembly of claim 1 further comprising a lock mechanism operative to lock said swing arm rotationally relative to said carriage.

10. The assembly of claim 1:

wherein said mounting platform further comprises a mounting frame supporting said rail, wherein said mounting frame detachably mounts to the vehicle;

wherein said carriage is slidable generally vertically along said rail and selectively lockable along to said rail; and wherein said swing arm further comprises a locking mechanism, said first and second elongate members of said swing arm selectively lockable rotationally relative to each other via said locking mechanism.

11. The assembly of claim 1 wherein said plurality of operative positions along said rail longitudinal axis is non-overlapping.

12. The assembly of claim 1 wherein said swing arm is supported by said mounting platform via a second bore in said carriage.

13. The assembly of claim 12 wherein said first bore is parallel to and spaced from said second bore.

14. The assembly of claim 12 wherein said first bore is perpendicular to said second bore.

* * * * *